US007152771B2

(12) United States Patent
Le Gal et al.

(10) Patent No.: US 7,152,771 B2
(45) Date of Patent: Dec. 26, 2006

(54) DEVICE FOR ADJUSTING THE CARRYING POSITION OF A RUCKSACK

(75) Inventors: Yann Le Gal, Biviers (FR); Matthieu Froidevaux, Parigny (FR)

(73) Assignee: Lafuma SA, Anneyron (FR)

( * ) Notice: Subject to any disclaimer, the term of this patent is extended or adjusted under 35 U.S.C. 154(b) by 343 days.

(21) Appl. No.: 10/811,718

(22) Filed: Mar. 29, 2004

(65) Prior Publication Data

US 2004/0178245 A1 Sep. 16, 2004

Related U.S. Application Data

(63) Continuation of application No. PCT/FR03/00786, filed on Mar. 12, 2003.

(30) Foreign Application Priority Data

Mar. 15, 2002 (FR) ..... 02 03497

(51) Int. Cl.
*A45F 3/04* (2006.01)
*A45F 3/08* (2006.01)
*A45F 3/10* (2006.01)

(52) U.S. Cl. ..... 224/631; 224/632; 224/634; 224/636

(58) Field of Classification Search ..... 224/627, 224/628, 631, 632, 634, 637, 636, 641, 578, 224/579, 162, 604, 633; 24/115 R
See application file for complete search history.

(56) References Cited

U.S. PATENT DOCUMENTS 5,920,963 A * 7/1999 Chou ..... 24/170
6,179,188 B1 * 1/2001 Gleason ..... 224/641
6,293,601 B1 * 9/2001 Johnson ..... 294/26
6,547,218 B1 * 4/2003 Landy ..... 254/217

FOREIGN PATENT DOCUMENTS

| | | |
|---|---|---|
| DE | 38 43 597 A1 | 6/1990 |
| EP | 0 405 035 A1 | 1/1991 |
| EP | 0 628 265 A1 | 12/1994 |

* cited by examiner

*Primary Examiner*—Jes F. Pascua
*Assistant Examiner*—Lester L. Vanterpool
(74) *Attorney, Agent, or Firm*—Burr & Brown

(57) ABSTRACT

The device for adjusting the carrying position of a rucksack consists of a rucksack back (1) on which a carrying harness (3) is positioned, characterized in that it comprises two means for controlling and adjusting the position (M1–M2), established with the aid of remote manual controls which are autonomous in relation to each other and which enable the position of the back of the sack to be adjusted in relation to the carrying harness, whereby the first means enables the back of the sack to be raised in relation to the harness and the second means enables the back of the sack to be lowered in relation to the harness, so that the dimensions of the back of the rucksack to the person carrying said rucksack can be adjusted the support areas can be modified during walking in order to reduce any injuries that might occur.

17 Claims, 16 Drawing Sheets

FIG. 6
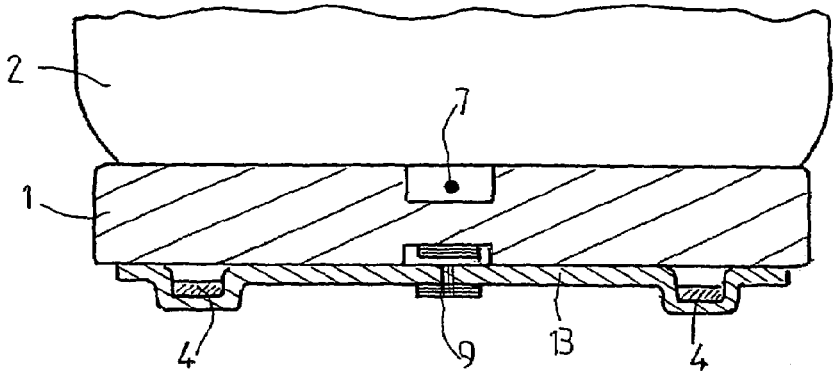
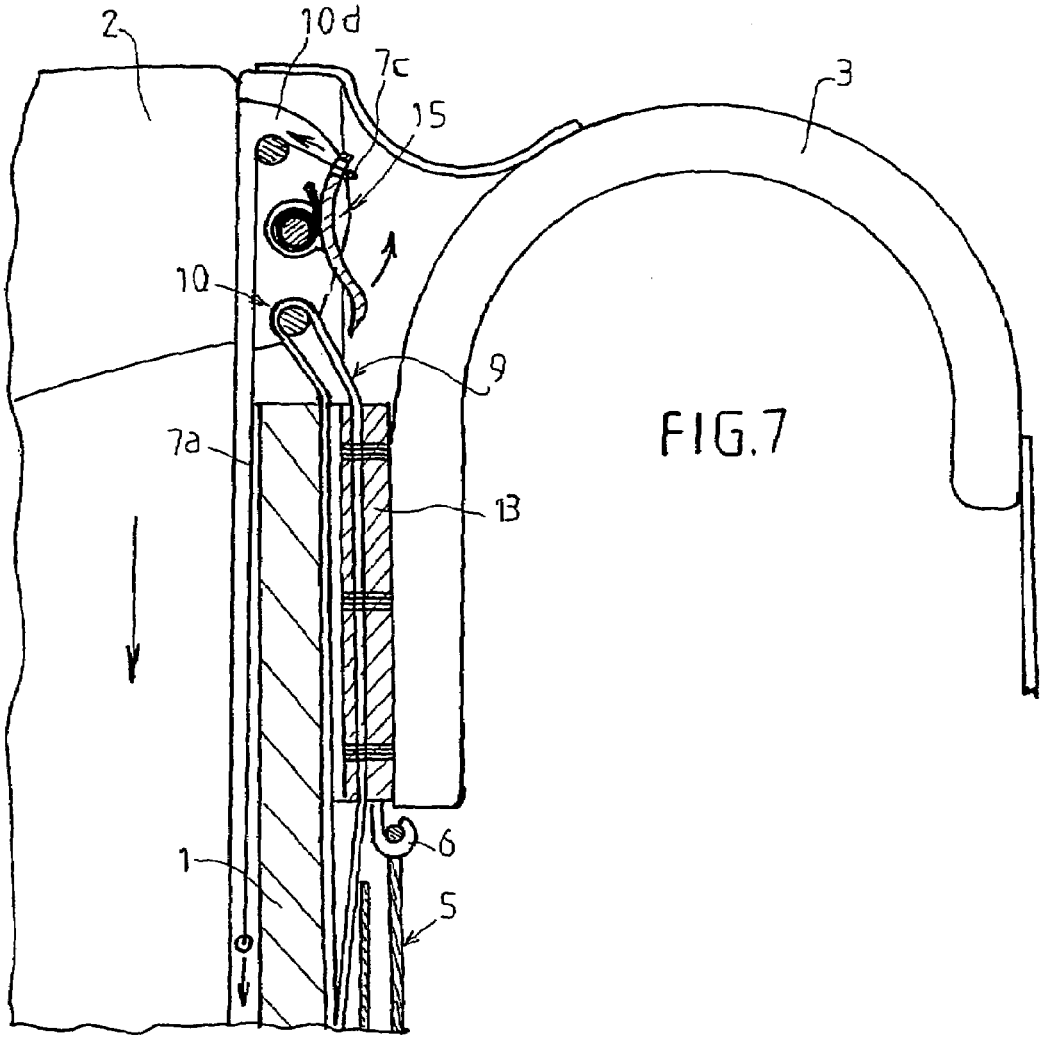
FIG. 7

DEVICE FOR ADJUSTING THE CARRYING POSITION OF A RUCKSACK

CROSS REFERENCE TO RELATED APPLICATIONS

This application is a continuation of International Application No. PCT/FR03/00786 having an international filing date of Mar. 12, 2003, which designated the United States, the entirety of which is incorporated herein by reference.

This application also claims the benefit of French Application No. 02.03497, filed Mar. 15, 2002, the entirety of which is incorporated herein by reference.

The invention relates to the technical field of rucksacks used in particular for hiking and hill walking.

According to the prior art, rucksacks in very general terms are equipped with shoulder straps which the wearer slips into, but they provide no positional adjustment. To bring relief to the wearer, some hiking bags have, projecting from the front of the bag, two loops which are positioned so that they come to the level of the wearer's shoulders. These loops can be grasped by each hand of the wearer and allow the bag to be raised partially, thereby relieving said wearer's shoulders.

Although this design already has certain advantages in improving the wearer's comfort, it nevertheless remains inadequate, especially for certain types of hikes requiring variable degrees of effort.

Thus, the Applicant has proposed to design the hiking rucksack in such a way as to allow the wearer to position the rucksack part in relation to the carrying harness part prior to setting out on a hike, this design being intended to meet two objectives, namely:

adaptation to the size of the individual, and modification of the adjustment while walking in order to prevent the rucksack from bearing for too long a time and with too great an intensity on the same area of the wearer, with the aim of sparing him any injury.

To this end, the Applicant has developed rucksacks in which the rucksack back could accommodate a carrying harness capable of being positionally adjusted manually with the aid of an attachment system of the type comprising, for example, hook-and-loop means, strap ladders or sliding straps. According to this implementation, the wearer would therefore have to put down the rucksack either prior to the hike or during it and then, in an approximate manner, adjust and fasten the harness in relation to the rucksack back.

This procedure was not practical, especially when the rucksack was full. Moreover, since the position of the harness on the rucksack is adjusted in an approximate manner, the desired effect of improving the wearer's comfort in all situations would remain limited. Furthermore, achieving the proper adjustment remains a laborious operation.

For these reasons, it was quickly found that there were restrictions in use of this type of rucksack, equipped with a rucksack back adjustable in relation to the adjusting harness.

The prior art discloses systems for the positional adjustment of the rucksack part in relation to the belting means. This is the case in particular in patent EP 405035. Two vertical strips forming rails are thus arranged, along which the belt moves. This implementation entails a certain degree of discomfort and positional adjustment can only be carried out in a relatively impractical manner.

Patent EP 628265 suggests another solution with means for remotely controlling the position of the components of the height-adjustable rucksack, but using a complex design.

Patent DE 3843597 also suggests adjusting the height of the rucksack in a complex implementation.

The situation of the prior art thus cited has not been considered as satisfactory by the Applicant for reasons of adjustment reliability, implementation costs, industrial production, and comfort.

In the light of this, the Applicant has continued its research in order to find a more effective and more rapid solution which allows the function of the rucksack to be adjusted on and by the wearer, offers better comfort and provides instantaneous adjustment, without the wearer being required to remove the rucksack, as has been practiced previously.

Another sought-after aim according to the invention was to optimize the precision of the adjustment by the wearer himself, in a simple and reliable manner without complex actions.

These aims and others still will clearly emerge from the subsequent description.

According to a first characteristic, the device for adjusting the carrying position of a rucksack of the type comprising a rucksack back on which a carrying harness is positioned, in an adjustable manner, by a remote manual control is characterized in that it comprises two positional adjustment and control means established with the aid of remote manual controls that are autonomous in relation to one another and allow the position of the rucksack back to be adjusted in relation to the carrying harness, the first means enabling the rucksack back to be raised in relation to the harness, and the second means enabling the rucksack back to be lowered in relation to the harness, in order to adapt the dimensions of the rucksack back to the back of the wearer and to modify the bearing zones while walking so as to limit and reduce any possible injuries, and in that the rucksack back is designed to accommodate an endless belt arranged in its central longitudinal plane, said belt being secured by a strand to the carrying harness and allowing the relative displacement of the rucksack back in relation to the harness by either or both of the positional adjustment and control means, and in that a locking mechanism urged by the second control means acts and allows the endless belt to be positionally immobilized or released according to the desired displacement phases.

These characteristics and others still will clearly emerge from the subsequent description.

In order to clarify the subject of the invention, illustrated in the figures of the drawings in which:

FIG. 6 is a view in transverse section on 6—6 of FIG. 3.

FIG. 7 is a view from the side and in partial section illustrating the release of the locking means, allowing the downward displacement of the rucksack back in relation to the harness.

In order to make the subject of the invention more specific, it will now be described in a nonlimiting manner illustrated in the figures of the drawings.

The rucksack, in particular for hiking, is denoted in its entirety by (S). It comprises a rucksack back (1) on which is fastened, in a known manner, the textile part forming the envelope (2) defining the volume of the rucksack. This is of traditional design and may be executed in any suitable manner. The rucksack back is constituted with a rigid lining material or in the form of a thermoformed shell coated with a textile lining. The rucksack back may also have, on the inside, a tubular framework or any other reinforcing inserts.

In a known manner, the rucksack back is able to accommodate, on its face on the wearer's side, a carrying harness (3) equipped with shoulder straps (3*a*–3*b*) enabling the rucksack to be carried. The adjustable positioning of the harness in relation to the rucksack back being known per se, as stated above, and may take place along slide rails (4) which are tubular or otherwise profiled and arranged along the rucksack back, the harness having passage loops along said slide rails.

The invention is targeted at a specific device allowing the positional adjustment of the rucksack back in relation to the carrying harness, and thus at the design of the rucksack back/harness assembly in order to provide this function. Said adjustment must thus be carried out in two displacement movements of the rucksack back in relation to the carrying harness, the latter being in a fixed position on the wearer.

The problem set by the invention was therefore to create an arrangement which allows a relative displacement of the rucksack back in relation to the carrying harness in a situation where the rucksack back is raised or the rucksack back is lowered in relation to the harness and this being done in an immediate and accessible manner in order to facilitate the adjustment operation.

Figure 9:
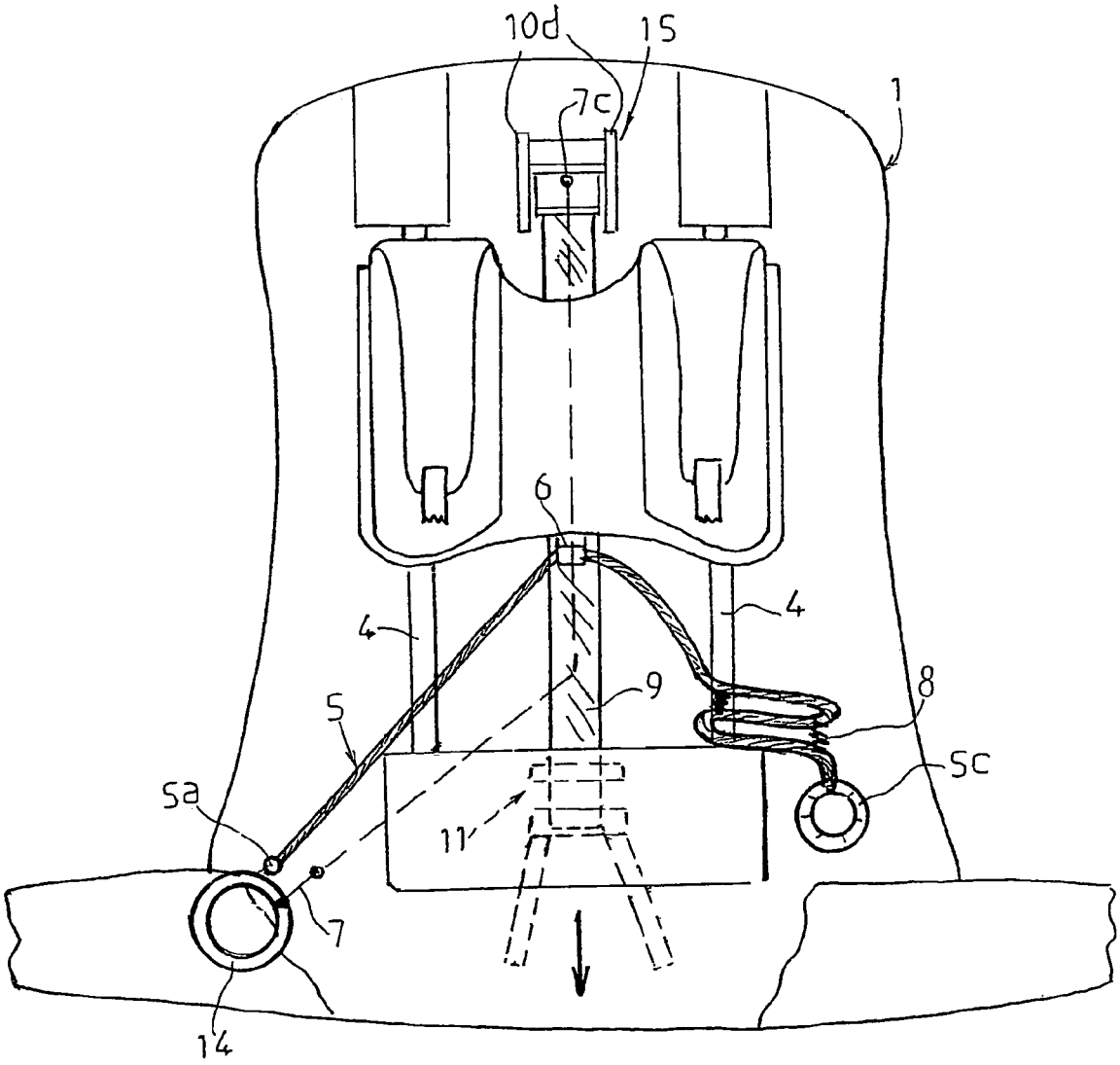

According to the invention, the device for adjusting the rucksack back in relation to the carrying harness comprises a first adjustment means (M1) established with the aid of a remote control urged manually be the operator himself. This first means has the essential function of being able to cause the rucksack back to be raised in relation to the harness. More specifically, it comprises a nonelastic traction cable (5), a first end (5*a*) of which is situated in the bottom part of the rucksack back, on one side of the latter, the other end (5*b*) having a grab ring or loop (5*c*). This said fixed end (5*b*) is in fact likewise positioned in the bottom part of the rucksack back but at the opposite side from the first end. A deflection means (6) is positioned fixedly in the central bottom part of the carrying harness, allowing the cable to pass through and travel around. It will thus be understood that any manual traction by the wearer on the loop will cause the cable to be pulled and thus the bottom part of the rucksack back to be moved closer to the bottom part of the harness, thus raising the rucksack back. The control ring is advantageously situated in the bottom part of the rucksack back in the wearer's lumbar region, and the wearer may, without difficulty, act manually on this control. To prevent the cable from hanging loose, provision is made for it to be retained by one or more elastic tension strands (8) which are arranged between parts of the cable (FIG. 9) so as to form a coiled configuration. In this way, said cable is always kept in position and is unable to swing unexpectedly, thus allowing the control ring to be retained in position. When the wearer releases his action on the cable, this makes it possible to position the rucksack back in relation to the carrying harness in the desired way.

The device of the invention likewise comprises a means (M2) for lowering the rucksack back in relation to the harness and thus refining the adjustment in the position of one in relation to the other.

More specifically, said means (M2), taken in its entirety, comprises a means (9) of connection between the harness and the rucksack back, allowing one to be displaced in relation to the other into positions of maximum raising or maximum lowering or intermediate positions, and a second control means (7) allowing the desired positional settings.

Figure 2:
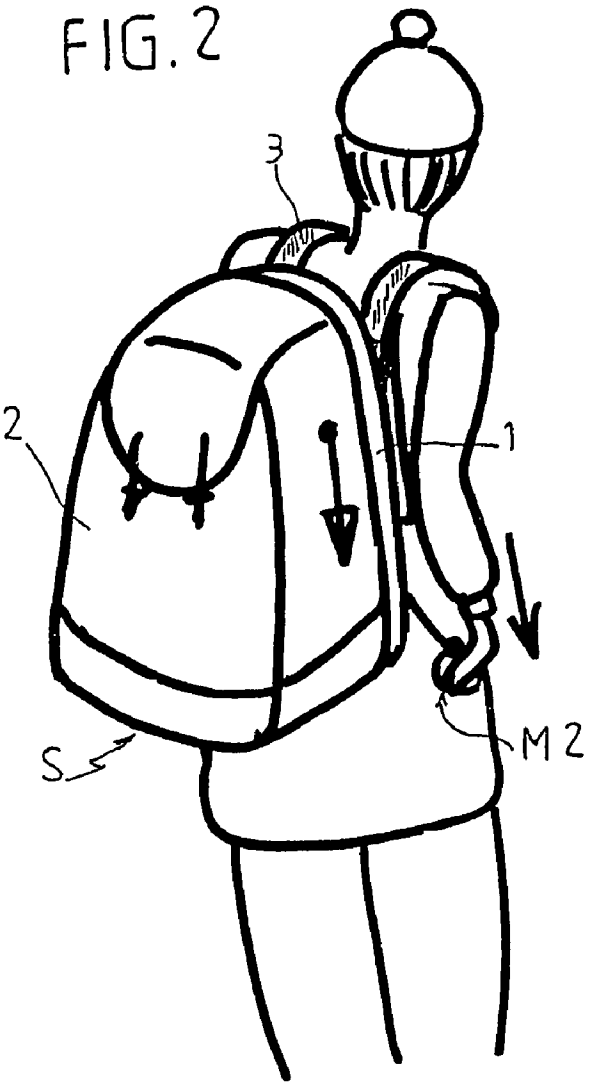
FIG. 2 is a schematic view illustrating the carrying of a rucksack and showing an intervention on the part of the wearer, right-hand side.
Figure 1:
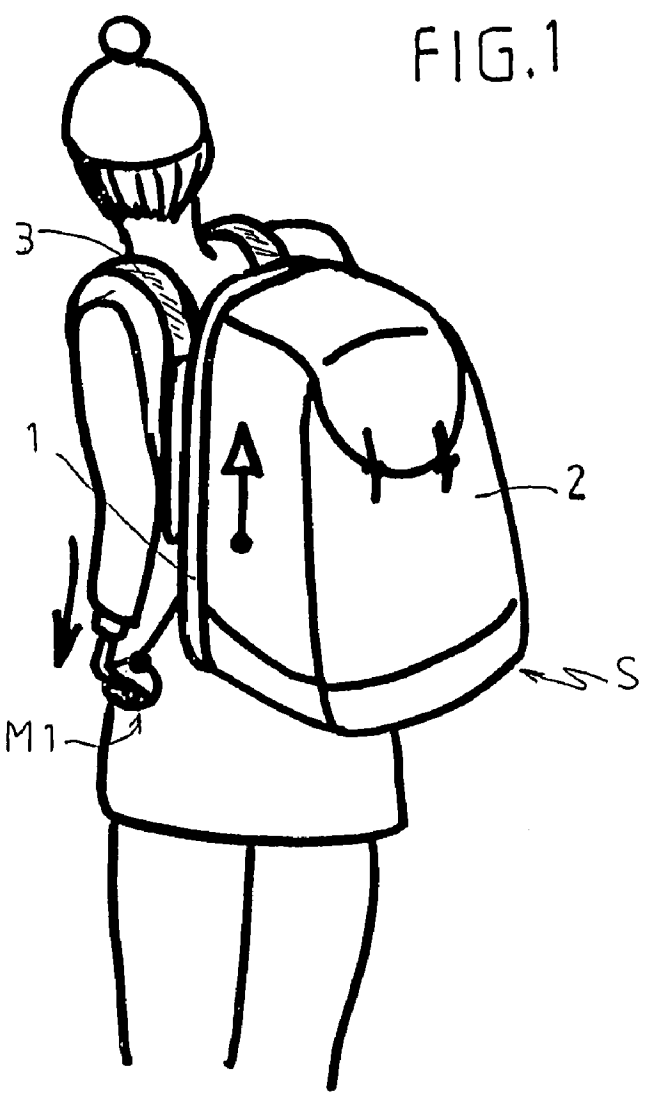
FIG. 1 is a schematic view illustrating the carrying of a rucksack and showing an intervention on the part of the wearer, left-hand side.
Figure 3:
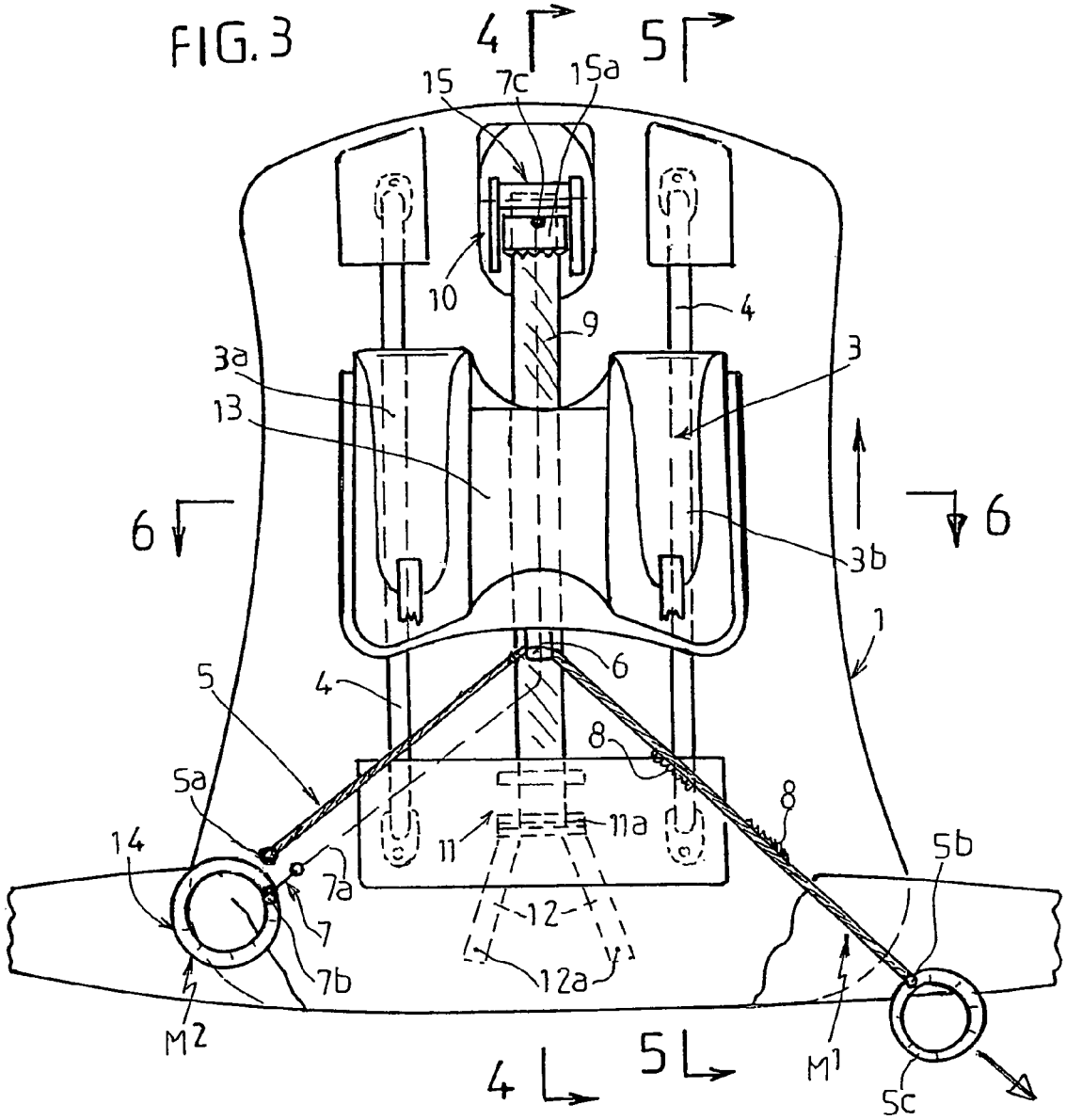
FIG. 3 is a front view of the rucksack back/carrying harness assembly according to the invention, in a first variant.

The connecting means (9) may be produced in the form of an endless belt made of any suitable materials, this belt being situated in the longitudinal mid-axis of the rucksack back. This belt is kept in tension, but is free to run around and is positioned in relation to a first deflection means (10) situated fixedly in the top part of the rucksack back, and in relation to a second deflection means (11) situated fixedly in the bottom part of the rucksack back. More particularly, in a nonlimiting implementation, each deflection means comprises a clevis block part (10*a*–11*a*) with a spindle (10*b*–11*b*) over which the strand of the belt passes. The clevis block (10*a*) of the upper deflection means is fastened to the rucksack back by any suitable means. The lower second deflection means (11) may be situated either directly in the bottom part of the rucksack back or in an intermediate position, as depicted in FIG. 3. In this case, and if it is not possible to have a fastening at the location of the rucksack back, provision is made for the second deflection means to be configured in such a way as to allow the fastening of two connecting and retaining ties (12) which are arranged, for example, in the shape of a V and fastened at (12*a*) in the bottom part of the rucksack back.

Figure 10:
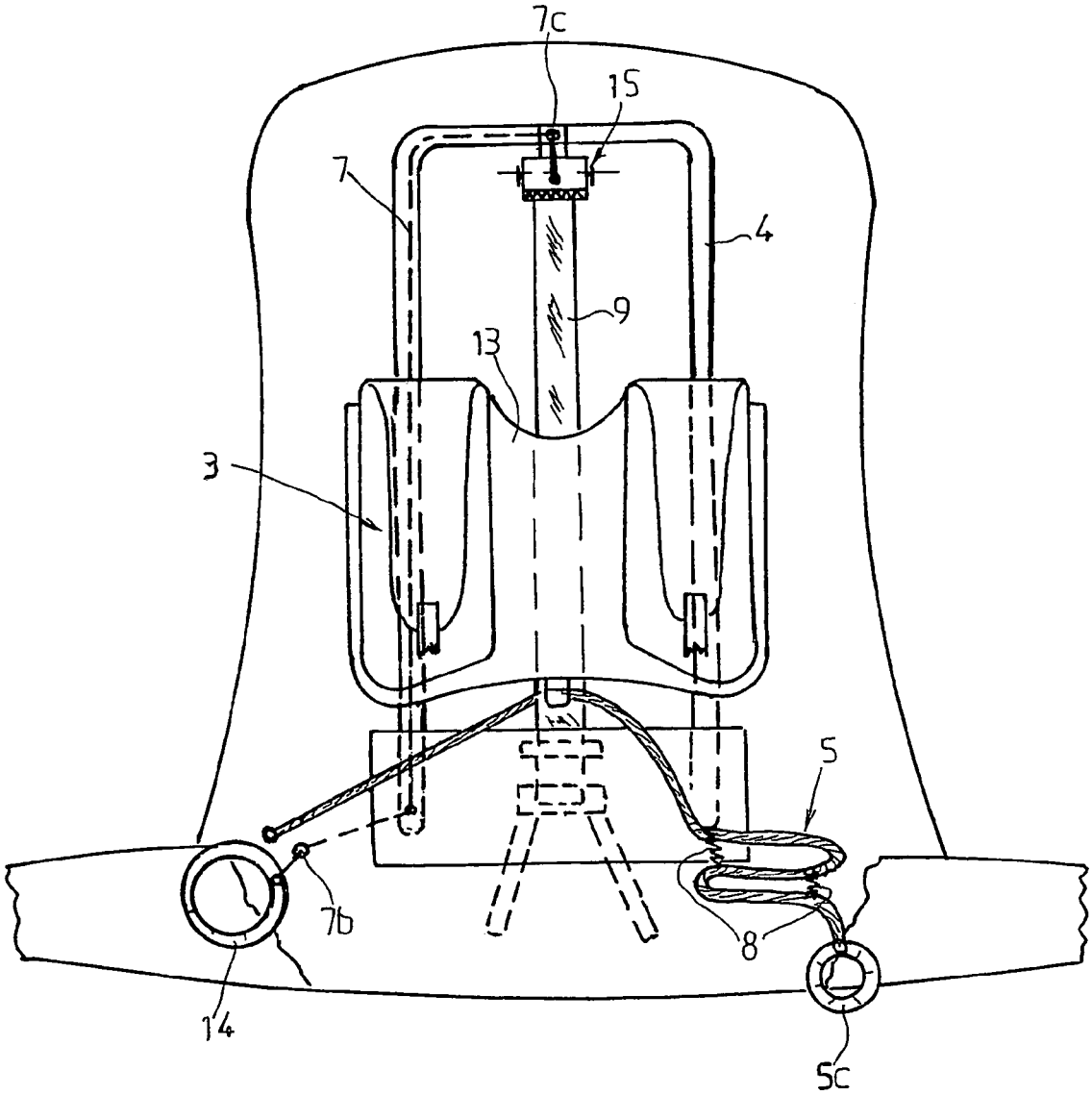
FIG. 10 is a partial view of the rucksack back illustrating another implementation.
Figure 11:
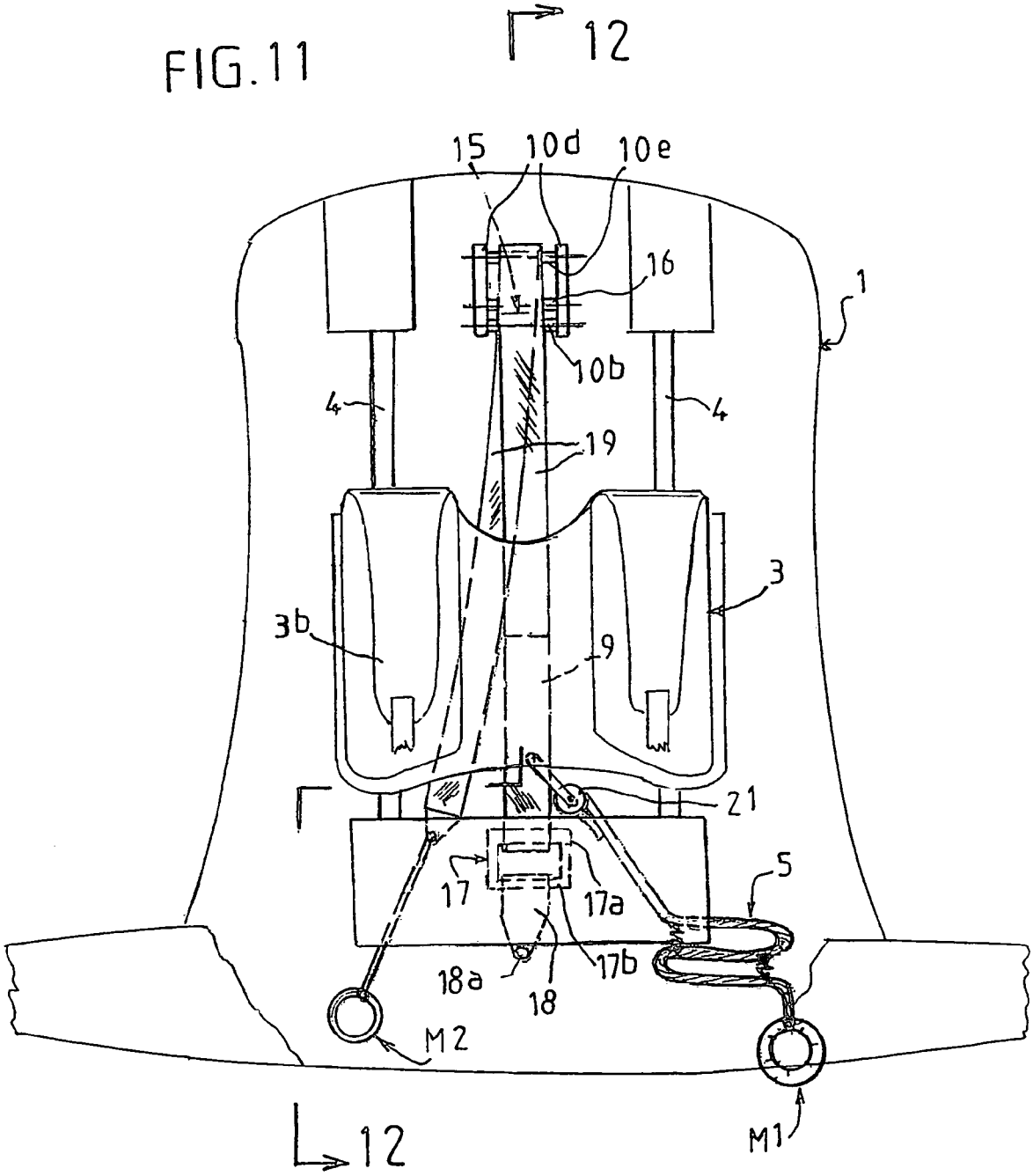
FIG. 11 is a front view of the rucksack back/carrying harness assembly according to the invention, in a second variant.
Figure 12:
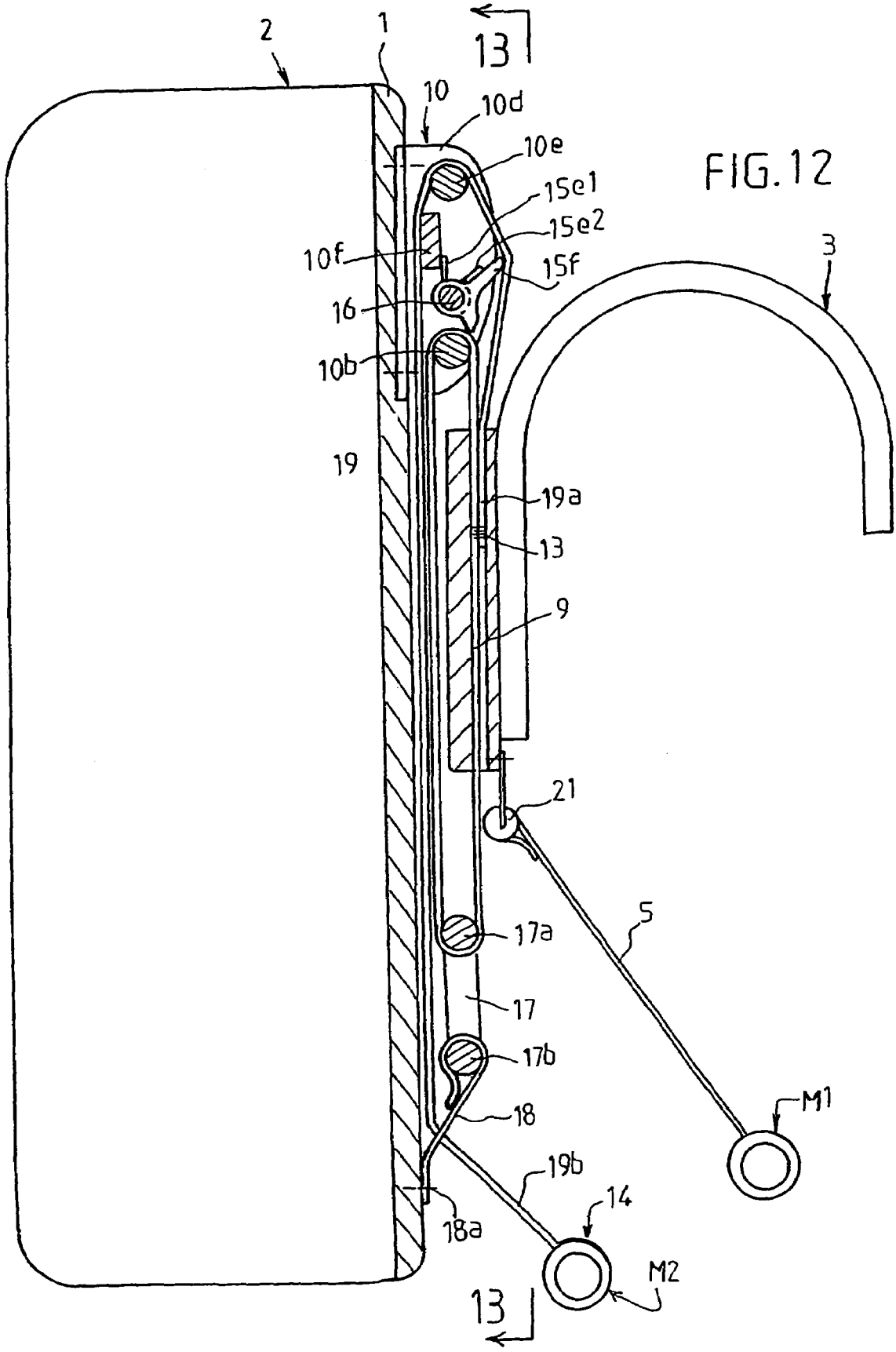
FIG. 12 is a view in longitudinal section on 12—12 of FIG. 11.
Figure 13:
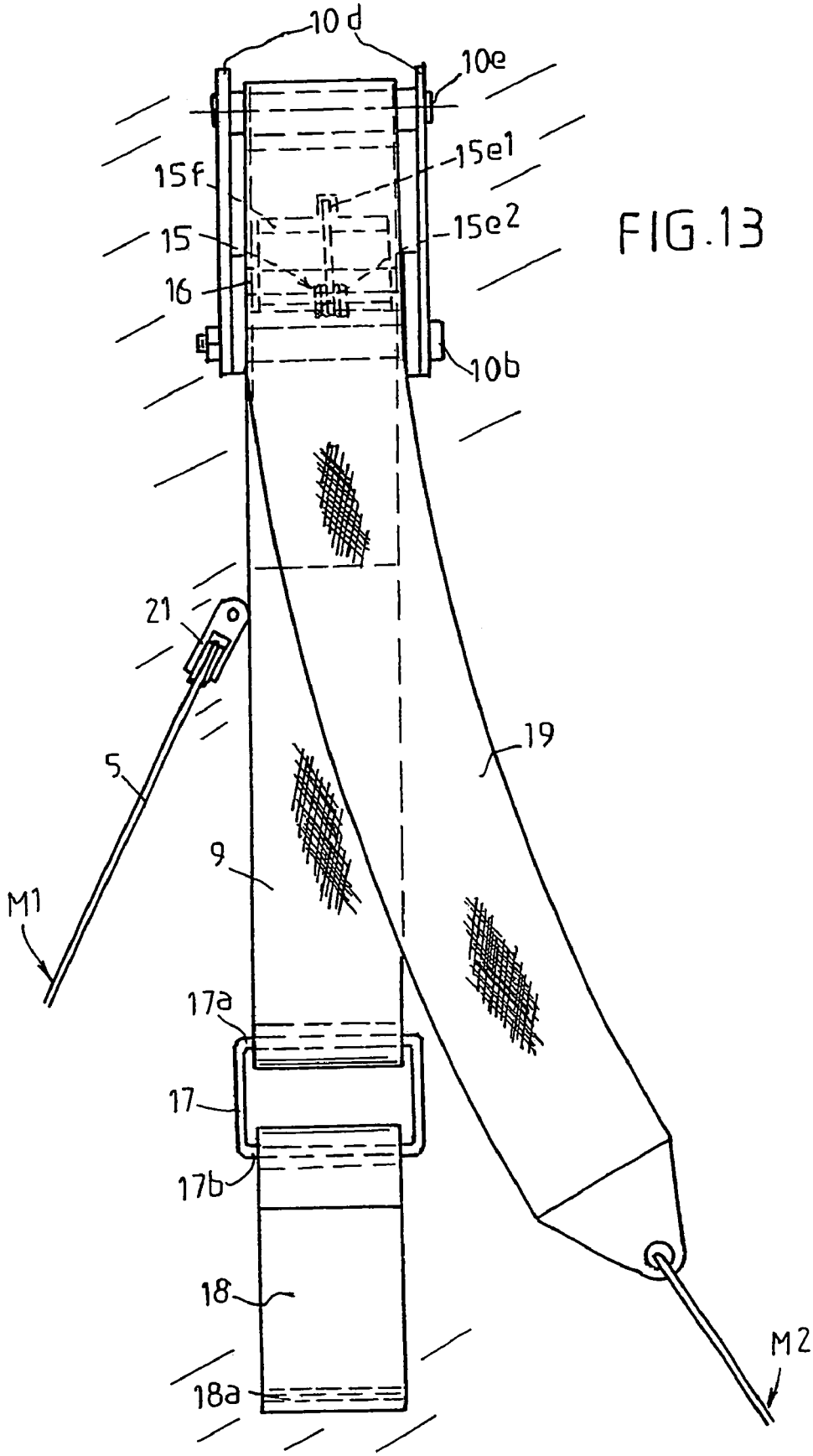
FIG. 13 is a rear view on 13—13 of FIG. 12, illustrating a variant of the implementation of the second control means.

In another implementation of said deflection means (10–11), these may be closed loops, of rectangular configuration for example, one part of which is secured to the rucksack back and the other is free for the passage of the endless belt. It is also possible to envision, as depicted in FIG. 10, that the framework has a U-shaped configuration with two longitudinal parallel branches forming slide rails and the horizontal connecting part in the top part of the rucksack back. In this case, the upper deflection means is fastened to the horizontal part of the framework. Said horizontal upper part has an opening for the passage of the means (M2), which will be described subsequently.

Figure 4:
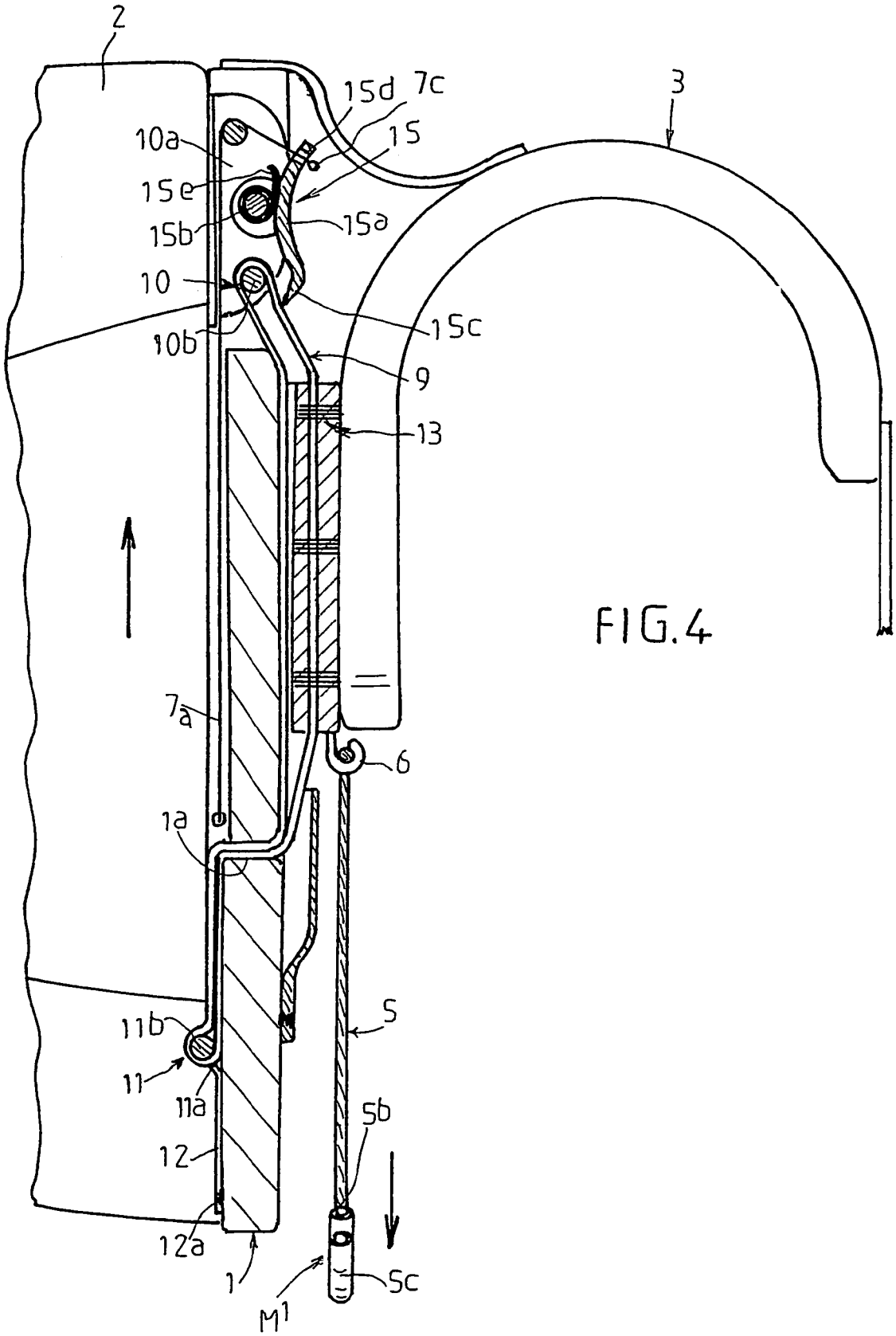
FIG. 4 is a view in longitudinal section on 4—4 of FIG. 3.
Figure 5:
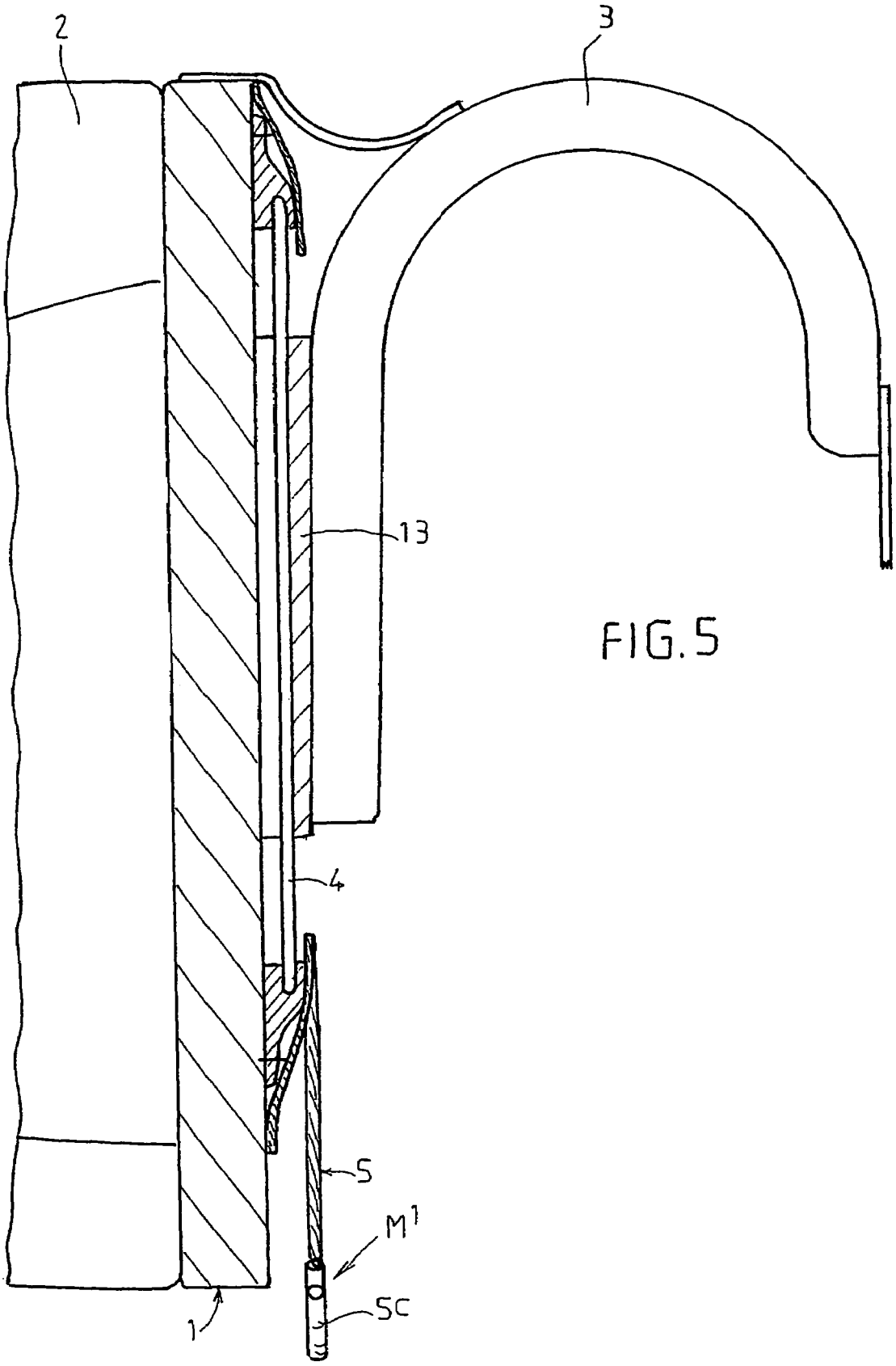
FIG. 5 is a view in longitudinal section on 5—5 of FIG. 3.
Figure 8:
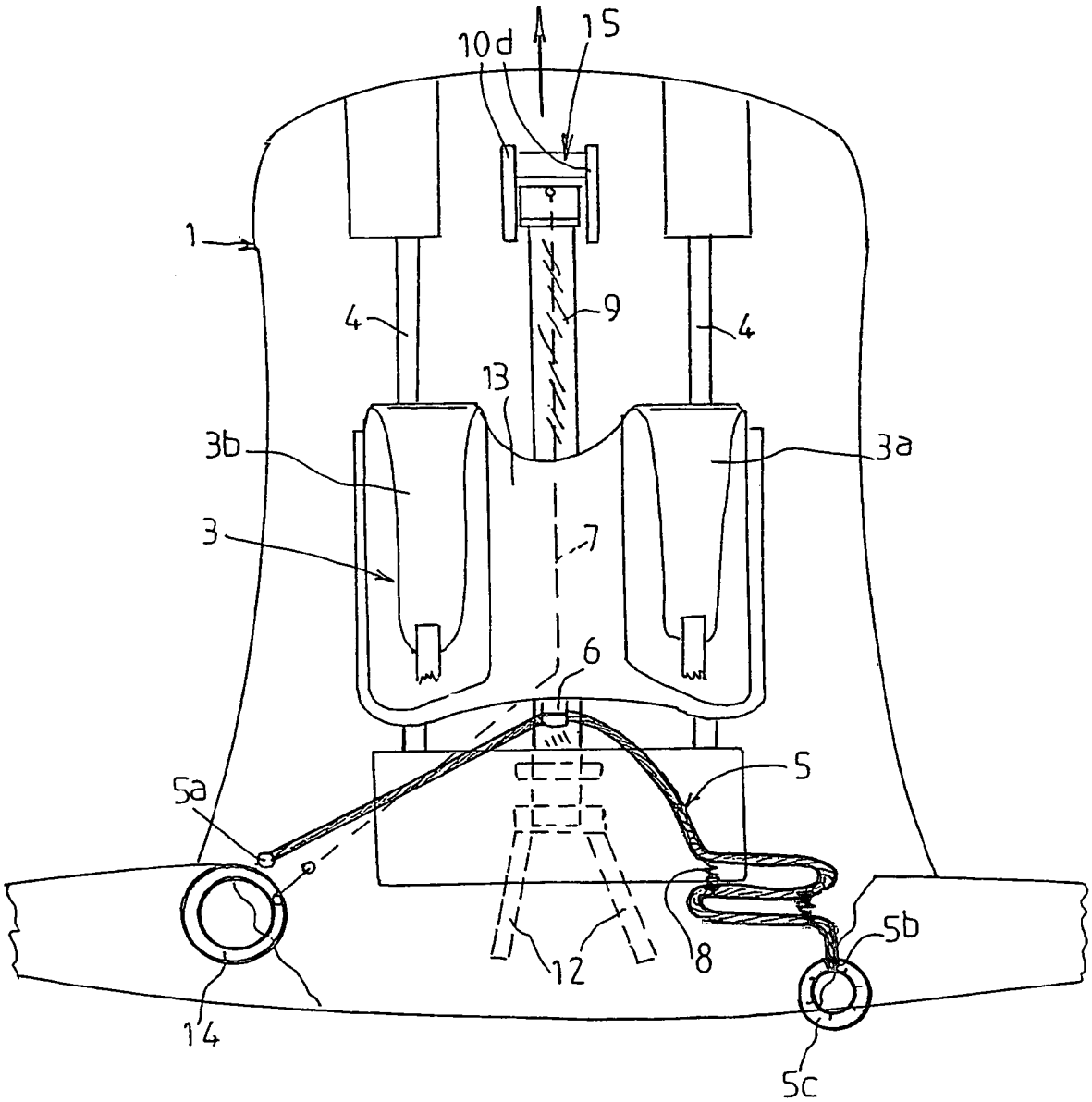
FIGS. 8 and 9 are front views of the rucksack back with respective positions of the latter in relation to the carrying harness.

The endless belt may be arranged on one side only of the rucksack back. However, as depicted in FIG. 4, it is advantageous for esthetic reasons for it to be able to be arranged with the top part arranged on the harness side and the lower part arranged on the rear side of the rucksack back. To this end, the rucksack back has a transverse slot (1*a*) allowing the belt to slide and pass freely. Moreover, said endless belt is, by way of one of its strands, secured to the carrying harness by one or more connecting means (13). It is thus understood that the displacement of the harness in relation to the rucksack back is closely associated with the displacement of said endless belt to an extent which is defined by the top and bottom external parts of the harness in relation to the rucksack back. Said harness/endless belt connection is established by any suitable means.

According to the invention, said second means (M2) comprises a second means (7) of control by the wearer. To this end, this second control means consists of a traction cable (7*a*) made from any suitable materials, this cable being noteworthy in that, at its lower end (7), it is associated with a second pull ring (14) and, at its upper end (7*c*), it is associated with a mechanism (15) for positionally locking and immobilizing the aforementioned endless belt, the intermediate part being denoted by (7*a*).

More typically, this traction cable may be sheathed and follow a specific course along the rucksack back. As depicted in FIG. 3 of the drawings, it may be arranged freely along the rucksack back, being guided for example by the means, associated with the harness, for deflecting the first cable, along an oblique path in the bottom of the rucksack back and then vertically. In a variant, it is possible to take advantage of the tubular framework (4) established in the rucksack back in order to introduce said cable therein and bring it, at its ends, toward the top part of the rucksack back at the location of the upper deflection means (10) for the belt, and close to the bottom part of the rucksack back for the pull ring, as depicted in FIG. 10.

According to an important arrangement of the invention, said second control cable (7) is associated with a locking mechanism (15) which can act on the aforementioned endless belt so as to allow or prevent the displacement of the latter under certain conditions.

More specifically, the clevis block constituting the upper first deflection means (10) for the endless belt (9) is designed to accommodate an additional horizontal spindle (16) mounted between the flanges of said clevis block and making it possible to accommodate an articulated immobilizing means (15) constituting the locking mechanism. The latter comprises a lever-forming tongue (15*a*) having, in its central part, an annular element (15*b*) arranged around the aforementioned spindle. Said tongue extends on either side of the annular element, having a serrated profile (15*c*) which can come into contact with and press against the facing part of the belt, and an extension (15*d*) at the rear which allows the end of the second control cable to be attached. A return means (15*e*) of the hairpin spring type is mounted on the aforementioned annular element and tends to tilt the tongue part so that there is always a continuous contact with the endless belt.

The implementation of this second control (M2) takes place in the following way. When the wearer acts on the associated ring (14), this exerts a traction on the cable (7), causing it to be pulled downward, and consequently the locking lever (15) to be raised, and releasing the endless belt (9) (FIG. 7). Through the effect of the load of the rucksack back, combined, where appropriate, with the traction effected by the wearer, the rucksack back, and therefore the rucksack part, has a tendency to be displaced downward in relation to the carrying harness. An adjustment therefore needs to be made in the bottom position, which is determined by the wearer himself.

Thus, the locking mechanism makes it possible to immobilize the belt when the control means (M1–M2) are not urged. When the means (M1) is urged, allowing the rucksack back to be raised in relation to the harness, the locking means rises automatically and allows the endless belt to proceed downward. When the means (M2) is urged, the locking means rises and allows the rucksack back to be lowered through its own load.

FIGS. 11 to 16 illustrate an alternative embodiment of the device for adjusting the carrying position of the rucksack. In this implementation, the parts or components described above retain the same references.

According to this solution, it was desired to essentially simplify the control means (M2) which causes the rucksack back, and consequently the rucksack, to be lowered in relation to the harness, while at the same time employing the same technical concept of locking the connecting belt (9) in position or releasing it.

The connecting belt (9) remains secured to the harness by connecting means (13) of the aforementioned type. In its lower part, said belt wraps around a spindle (17*a*) of an attachment (17) in the form of a buckle, while the second spindle (17*b*) of this attachment can have a band (18) wrapped around it, the lower end (18*a*) of which band is fastened in a suitable manner onto the rucksack back in its lower part.

The endless connecting belt (9) is held in greater tension on the spindle (10*b*) of the upper deflection means (10) described above and is situated between the flanges (10) of the latter. The deflection means (10) includes the additional spindle (16) on which the locking mechanism (15) is articulated. The deflection means includes an upper spindle (10*e*) between the flanges (10*d*), the function of which will be stated subsequently. The locking means mounted pivotably on the spindle (16) is designed with a serrated profile (15*c*) which can come into contact with and press against the facing part of the endless belt (9). In this embodiment, the locking means (15) has an extension (15*f*) which forms a V-shaped angle with the serrated profile (15*c*) and is in a plane outside of the plane of said profile (15*c*), as depicted more particularly in FIG. 12. The return spring (15*e*) of the hairpin spring type is mounted on the spindle (16) and one of its branches (15*e*1) is able to bear against a bearing wall (10*f*) formed on the deflection means (10) and the other branch (15*e*2) bears against the rear face of the extension (15*f*).

Thus, according to the invention, this variant of implementing the control device (M2) consists in using a strap (19), one end (19*a*) of which is secured to the connecting belt (9) in a region situated at the location where said belt (9) is fastened to the harness, or, in a variant, at the same location. As appears in FIGS. 11 to 16, said strap (19) passes around the locking mechanism (15) and bears against the latter, in particular against the extension part (15*f*) of the tilting lever. The strap is then guided around the upper spindle (10*e*) in order to then be guided between the rucksack back and the rear strand of the connecting belt (9). Thus, the second end (19*b*) of the strap is associated with and secured to the ring (14) of the aforementioned type of the control means (M2). Said second end (19*b*) of the strap (19) is free in position, as depicted, for example, in FIG. 13, in order to be pulled by the user in all positions. It is thus possible to conceive of the strap (19) being guided by means of one or more bands fastened in the bottom part of the rucksack back.

Figure 14:
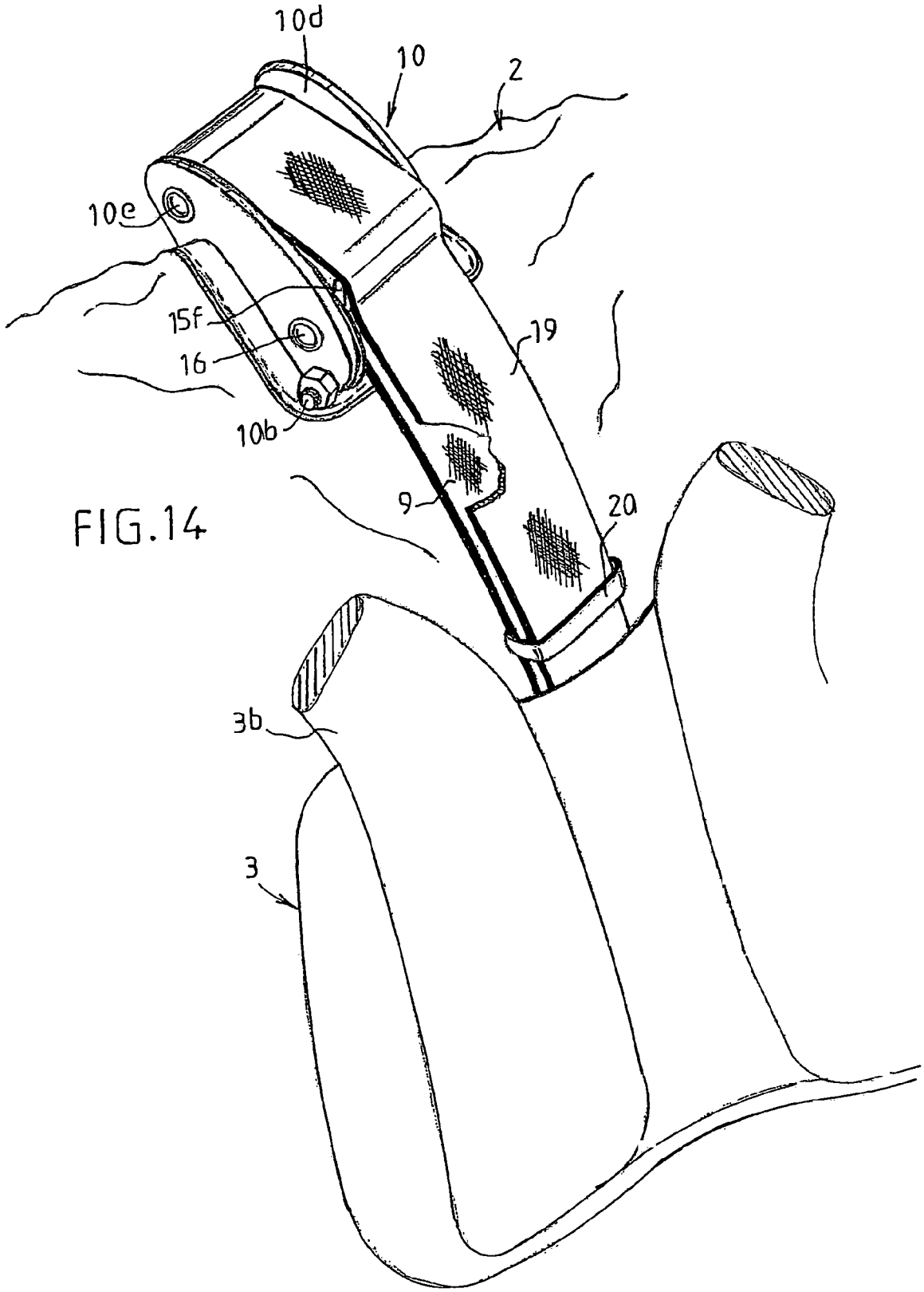
FIG. 14 is a partial perspective view of the rear of the rucksack back, showing a variant of the device.

FIG. 14 depicts, moreover, the use of a clip (20) for guiding the strap or a strand of the connecting belt (9) toward the deflection means (10). In this embodiment, the cable (5) of the first control means is fastened by means of a connecting loop (21) to the harness.

In this implementation, the strap may be freely tilted laterally in relation to the rucksack back and be actuated by the user in the most practical way for the latter.

Figure 15:
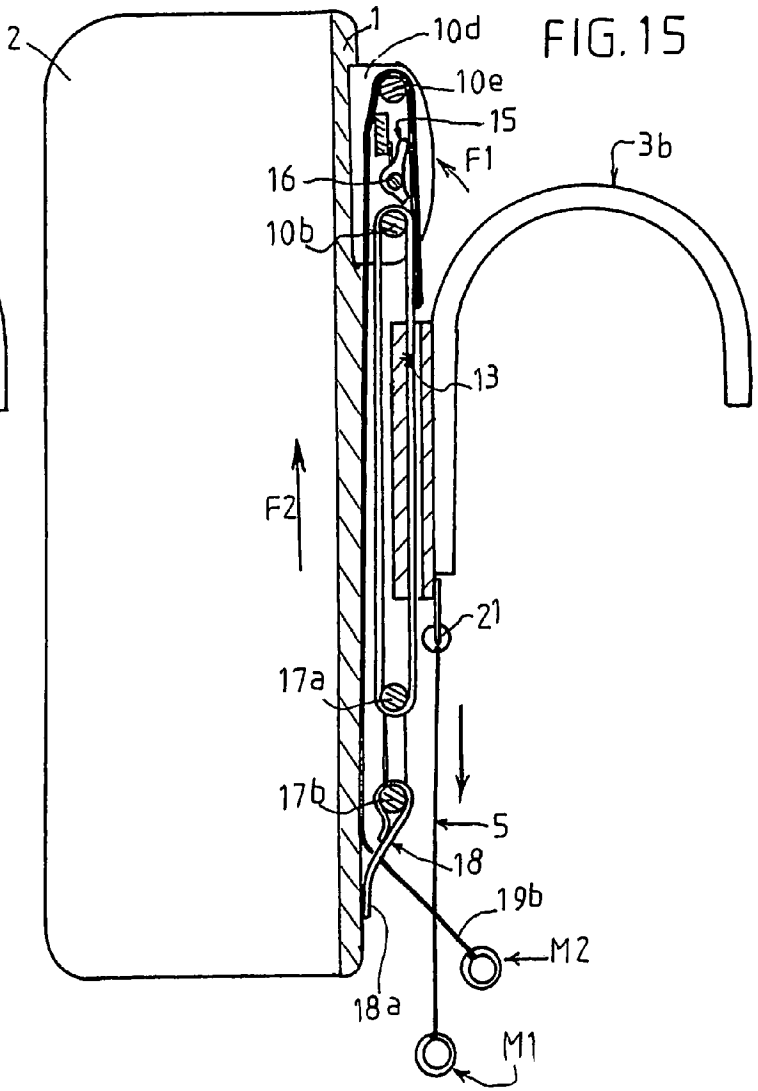
FIG. 15 is a schematic view illustrating the action on the first control means causing the rucksack back to be raised in relation to the harness.
Figure 16:
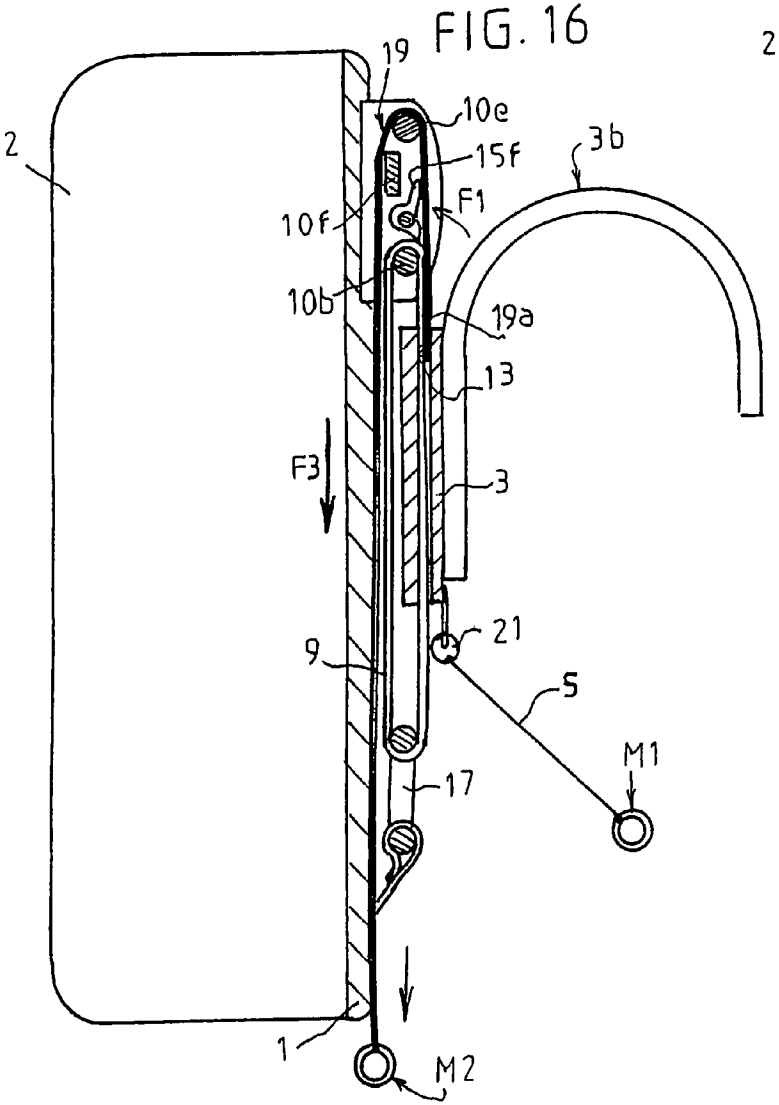
FIG. 16 is a schematic view illustrating the action on the second control means in the implementation of FIGS. 11 to 15.

Reference should be made to FIGS. 15 and 16 in order to explain the ways of using the device of the invention.

According to FIG. 15, the actuation of the control means (M1) leads to the cable (5) being urged and therefore to the traction of the connecting belt (9) associated with the harness to which the end (5*a*) of the cable is attached. That causes the belt (9) to travel downward and to do so against the action of the locking means (15) which pivots as indicated by the arrow (F1), the rucksack back is lifted as indicated by the arrow (F2), the harness remaining in place on the user.

According to FIG. 16, the actuation is this time carried out on the control means (M2); that leads to the actuation of the strap (19). Through the force of traction, the strap causes the lever (15) to pivot by bearing against its extension branch (15*f*), thus releasing the connecting belt (9). That allows the downward displacement of the rucksack back as depicted in FIG. 3.

FIGS. 17 to 22 depict an alternative implementation of the invention in the adjustment of the carrying position of the rucksack, but also including a means for checking and reading the position, which allows the wearer to memorize the rucksack back/harness relative positions which are most appropriate according to the use conditions.

In the representations of FIGS. 17 to 22, the parts or components described above retain the same references.

Figure 17:
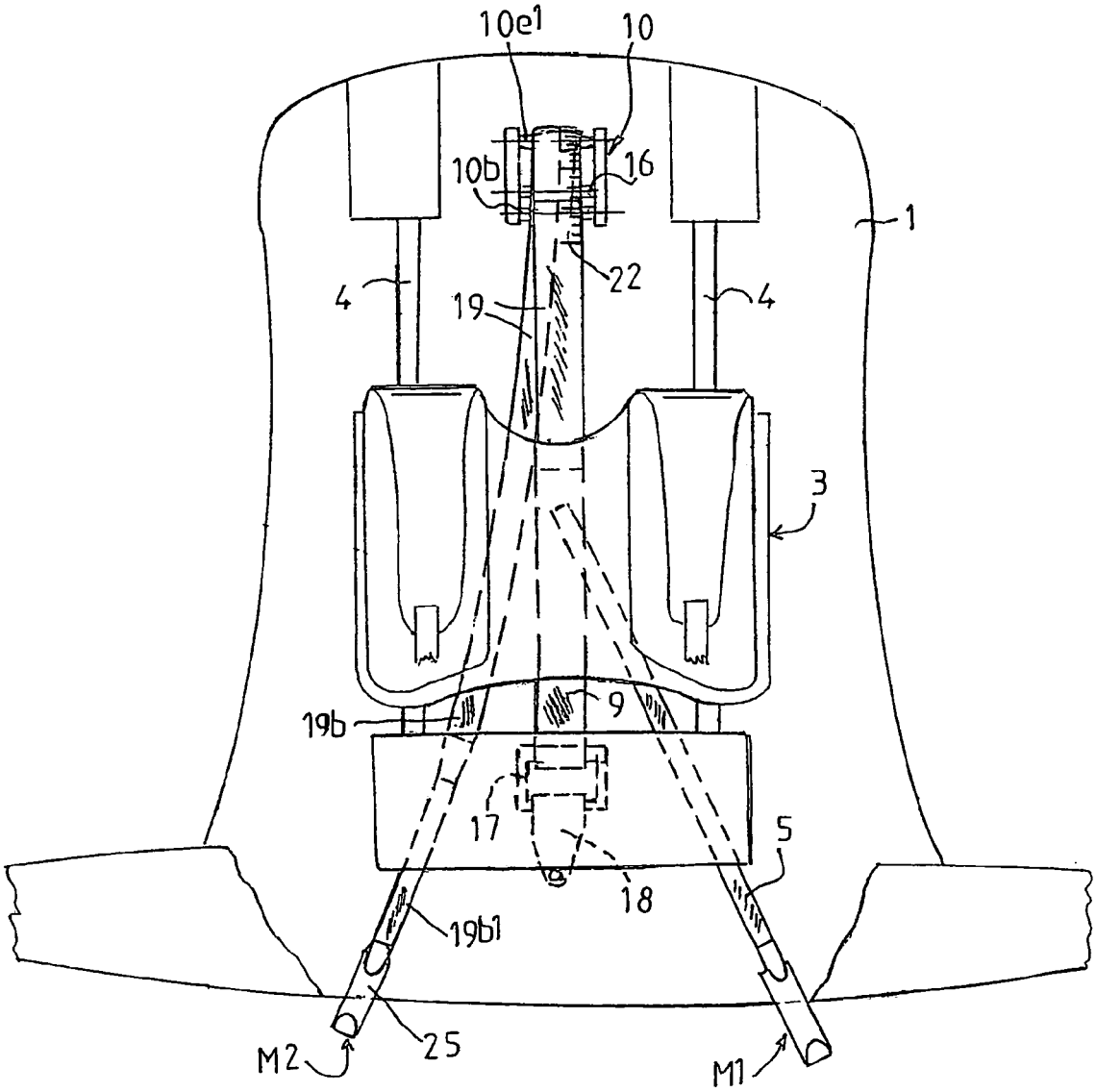
FIG. 17 illustrates, in a front view, another implementation of the rucksack back/harness assembly and of the second positional adjustment control means.
Figure 19:
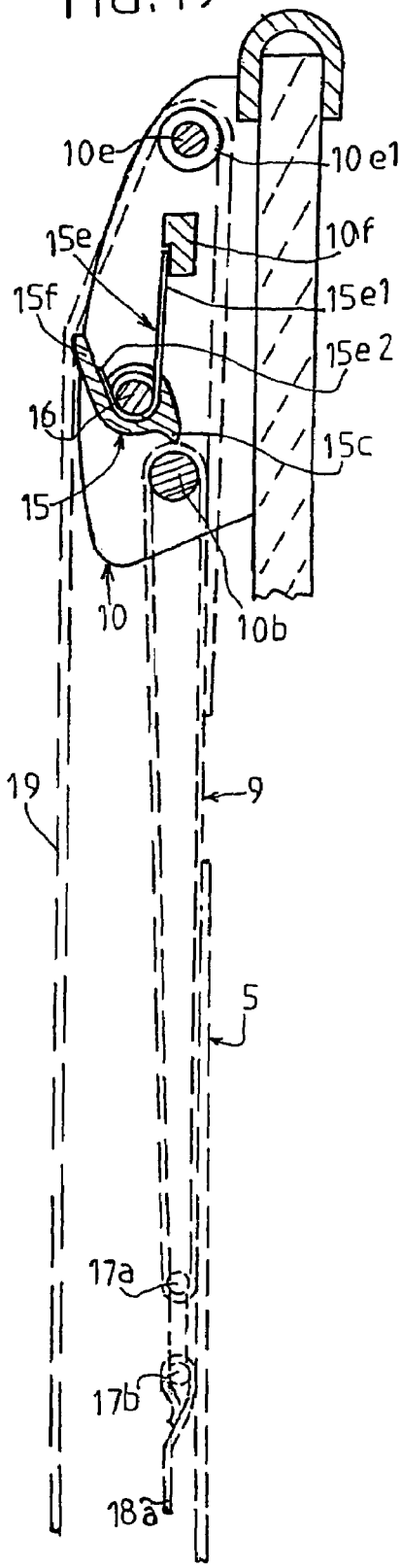
FIG. 19 is a sectional view on 19—19 of FIG. 18.
Figure 18:
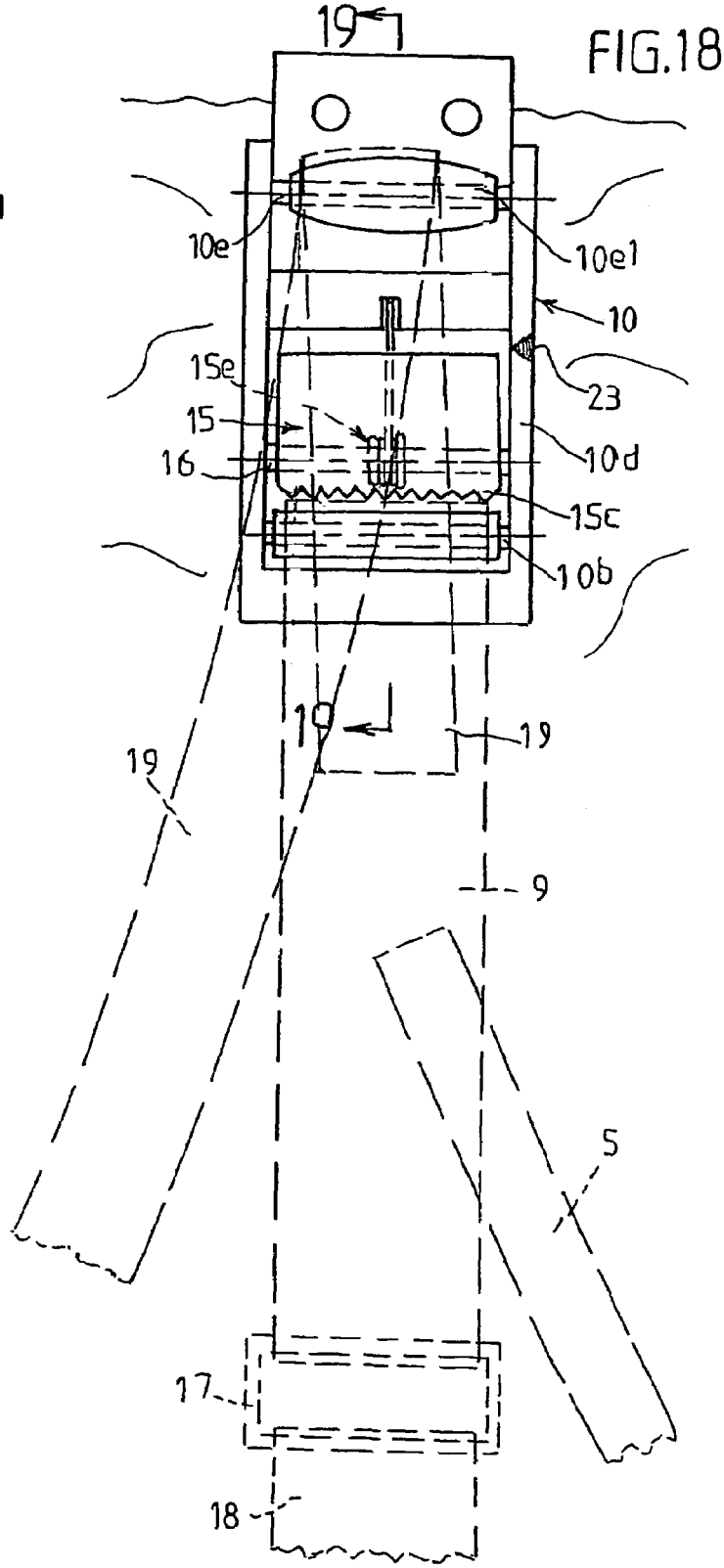
FIG. 18 is a large-scale partial view illustrating the design of the upper deflection means.
Figure 21:
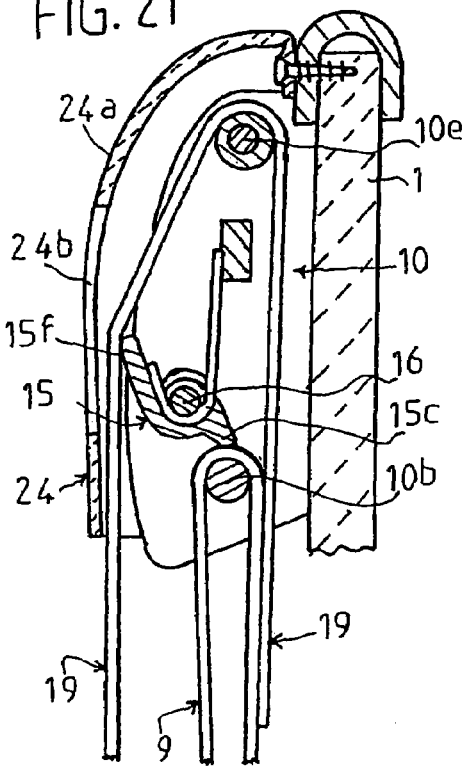
FIG. 21 is a view in section on 21—21 of FIG. 20.
Figure 20:
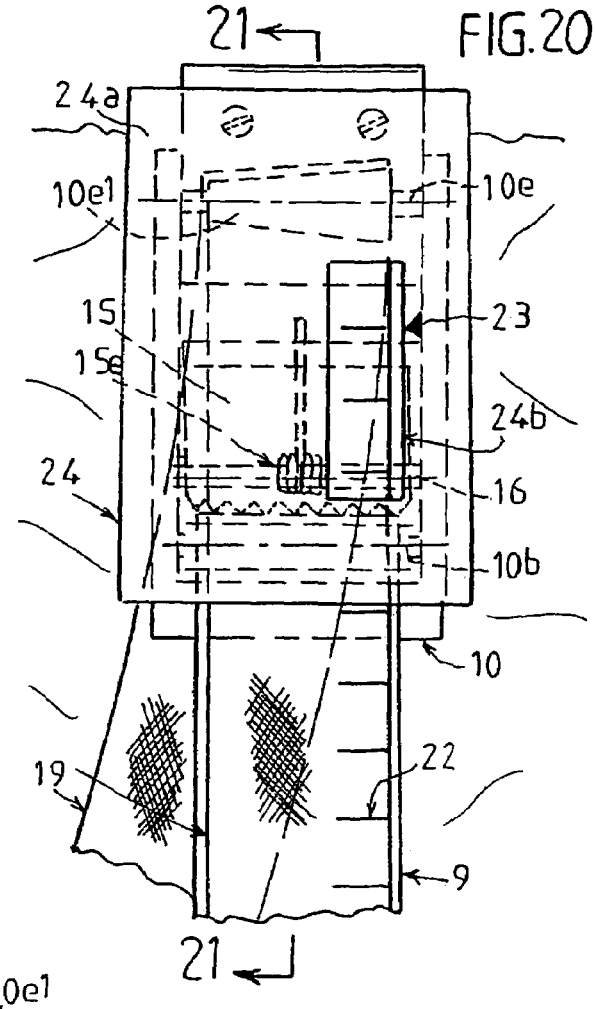
FIG. 20 is a partial view similar to FIG. 18, but the upper deflection means is protected by a protective reading cap.
Figure 22:
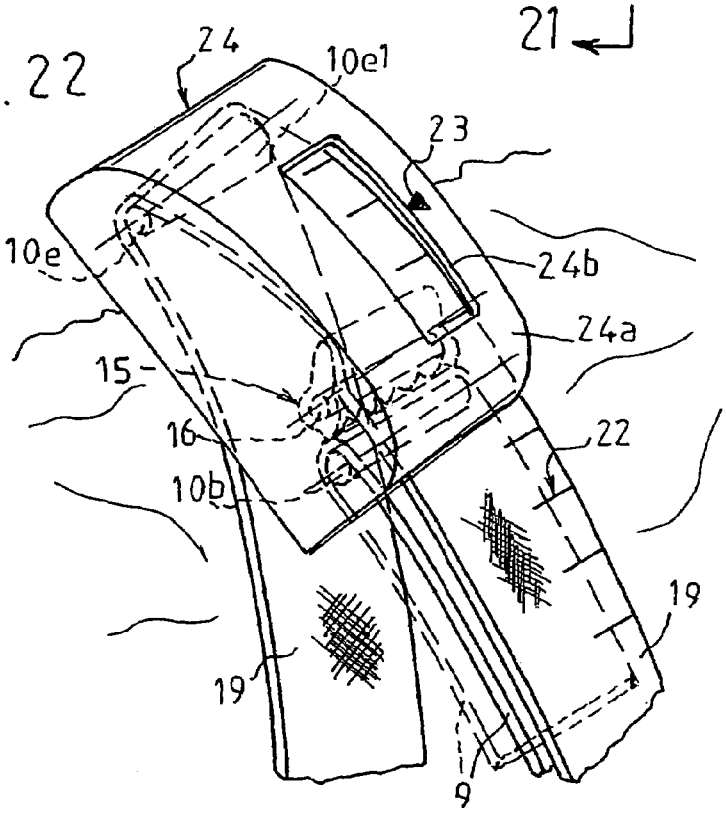
FIG. 22 is a partial perspective view illustrating the use of the protective cap for checking the position of the strap for adjusting the position of the harness in relation to the rucksack back.

In this implementation, the upper deflection means (10) has a spindle (10*e*) which allows the passage and the deflection of the strap (19). In order to allow said strap (19) to be oriented obliquely outside the plane of the endless connecting belt (9), and in order to be pulled by the wearer, the spindle (10*e*) is shaped to have a convex or conical configuration (10*e*1). This convex or conical configuration depends on the width of the strap (19) and on the choice of the orientation given to the positioning of the latter. The effect of this is to allow the strap (19) to be oriented laterally by sliding and to cause it to assume the oblique position as depicted in FIGS. 17 and 18. In the case where the strap may be pulled in an orientation to the right or to the left of the rucksack back, said spindle (10*e*) has a convex configuration and the width of the strap (19) is less than half the length of the spindle (10*e*) in order to be positioned and slid either to the right or to the left, giving the desired orientation. If the strap (19) is oriented obliquely only on one side, the spindle (10*e*) is conical with a slope oriented in the direction of the side for positioning the strap. The width of the strap may then be larger.

Moreover, and as it appears from FIG. 17, the free end (19*b*) of the strap (19), which other end (19*a*) is secured to the harness and to the endless belt, presents a narrowed form (19*b*1), directly obtained by weaving, braiding or otherwise, allowing the coupling to the control handle of the means (M2) produced in the form of a grab strip (25) of elastomeric material, for example. In this implementation, the strap (19) thus arranged constitutes overall the control means (M2) for the relative positioning of the rucksack back and of the harness.

According to a specific arrangement, the strap (19) has over part of its length, approximately at the point where it passes over and around the deflection means (10), a scale (22) which is graduated with a pre-established pitch and thus defines relative positions of the rucksack back in relation to the harness.

This graduated scale (22) is visible to the wearer, and an identification index (23) may be established on the aforementioned deflection means (10) for establishing the reference base.

In a specific implementation, however, the upper deflection means (10) is designed to receive a cap (24) for protecting the whole of the locking mechanism (15). This protective cap (24) is mounted fixedly or articulated on the deflection means, and it is produced from any suitable material. It has on its front face (24*a*) a vertical window (24*b*) which can face the strap (19) and its graduated scale in particular. The cap then has the reference index (23). The wearer can therefore see the graduated area of the strap (19) perfectly and memorize the appropriate graduations corresponding to specific positions of the rucksack back in relation to the harness. This design is practical since adjustment is rapid, all the more so if there are many different wearers of the rucksack, or if adjustment modifications need to be made as a result of inappropriate manipulation. The graduated scale may be numerical, alphanumerical or of other type.

Generally, the solution of using the strap (19) is practical for the purpose of a more appropriate industrial implementation of the invention. However, all the implementations of the invention applying the concept of the invention as it relates to the connecting belt and the mechanism for locking/unlocking the latter in position may be used.

Thus, according to the invention, the wearer may adjust and optimize, micrometrically, the positioning of the rucksack back in relation to the carrying harness by acting on the two rings at his disposal. This adjustment is performed when the rucksack is carried by the hiker, without there being any need for the hiker to put it down.

Installation is easy to perform and simple in its implementation. The solution provided allows improved comfort to be offered to the wearer, who may adjust the position of his rucksack in any circumstances and immediately. Checking the position of the rucksack back in relation to the harness also provides user comfort.

Without departing from the scope of the invention, the control means, namely the rings, may also be arranged on the flanks of the wearer, only the circuits for positioning and displacing the control means being modified.

In a variant, the traction cables may be established in the form of straps, hooks, cords or the like, for the same function.

The invention claimed is:

1. A device for adjusting the carrying position of a rucksack of the type comprising a rucksack back on which a carrying harness is positioned, said device comprising:

two positional adjustment and control means established with the aid of remote manual controls that are autonomous in relation to one another and allow the position of the rucksack back to be adjusted in relation to the carrying harness, the first means enabling the rucksack back to be raised in relation to the harness, and the second means enabling the rucksack back to be lowered in relation to the harness, in order to adapt the dimensions of the rucksack back to the back of the wearer and to modify the bearing zones while walking so as to limit and reduce any possible injuries, wherein the rucksack back accommodates an endless belt arranged in its central longitudinal plane, said belt being secured by a strand to the carrying harness and allowing the relative displacement of the rucksack back in relation to the harness by at least one of the positional adjustment and control means, and wherein a locking mechanism urged by the second control means acts and allows the endless belt to be positionally immobilized or released according to the desired displacement phases.

2. The device as claimed in claim 1, characterized in that the first adjustment means comprises a nonelastic traction cable, a first end of which is situated in the bottom part of the rucksack back, on one side of the latter, the other end having a grab ring or loop, and in that said fixed end is in fact likewise positioned in the bottom part of the rucksack back but at the opposite side from the first end, and in that a deflection means is positioned fixedly in the central bottom part of the carrying harness, allowing the cable to pass through and travel around.

3. The device as claimed in claim 2, characterized in that, in order to prevent the cable from hanging loose, provision is made to retain it using one or more elastic tension strands arranged between parts of the cable in order to form a coiled configuration.

4. The device as claimed in claim 1, characterized in that the endless belt is kept in tension, but is free to run around and is positioned in relation to a first deflection means situated fixedly in the top part of the rucksack back, and in relation to a second deflection means situated fixedly in the bottom part of the rucksack back.

5. The device as claimed in claim 4, characterized in that the lower second deflection means is situated either directly in the bottom part of the rucksack back or in an intermediate position while having a configuration allowing the fastening of two connecting and retaining ties arranged in a V shape and fastened at in the bottom part of the rucksack back.

6. The device as claimed in claim 1, characterized in that said second means comprises a second control means consisting of a traction cable, this cable being noteworthy in that, at its lower end, it is associated with a second pull ring and, at its upper end, it is associated with a mechanism for positionally locking and immobilizing the belt.

7. The device as claimed in claim 6, characterized in that said second control cable is associated with a locking mechanism which can act on the aforementioned belt in order to allow or prevent the displacement of the latter under certain conditions.

8. The device as claimed in claim 7, characterized in that the upper first deflection means for the belt is designed in the form of a clevis block which has a spindle over which the belt strand passes and which accommodates an additional horizontal spindle for receiving an articulated immobilizing means constituting the locking mechanism, comprising a lever-forming tongue which has, in its central part, an annular element arranged around the aforementioned spindle, and in that said tongue extends on either side of the annular element, having a serrated profile which can come into contact with and press against the facing part of the belt, and an extension at the rear for attaching the end of the second control cable, and in that a return means of the hairpin spring type is mounted on the aforementioned annular element and tends to tilt the tongue part so that there is always continuous contact with the belt.

9. The device as claimed in claim 8, characterized in that the rucksack back comprises a U-shaped tubular skeleton whose longitudinal branches constitute slide rails for guiding the carrying harness in displacement, and the horizontal upper connecting part being able to accommodate the upper deflection means, itself accommodating the locking means, and in that the cable is fitted in one of the branches of the tubular framework so as to be guided until it connects with the locking mechanism, exiting via the opening formed in said upper part.

10. The device as claimed in claim 4, characterized in that the upper deflection means is in the form of a clevis lock with, between the flanges, a lower spindle for fastening the connecting belt, and an upper spindle for deflecting a strap constituting the control means, and in that between the spindles there is arranged a spindle around which is pivotably mounted the locking mechanism established in the form of a lever which tilts against the action of an elastic return means, said lever being oriented so that it has a serrated profile in contact with and pressing against the facing wall of the connecting belt, and an extension strip for offsetting the strap when the mechanism is not urged.

11. The device as claimed in claim 10, characterized in that the strap has one end secured to the harness and to the connecting belt, and another end associated with the traction ring, said strap passing around the locking mechanism and being arranged between the rucksack back and the rear strand of the connecting belt when returning toward the ring.

12. The device as claimed in claim 10, characterized in that the lower end of the connecting belt is mounted around a spindle of an attachment in the form of a buckle, said attachment including a second spindle around which can be wrapped a band whose lower end is fastened onto the rucksack back.

13. The device as claimed in claim 10, characterized in that the return means of the hairpin spring type is mounted onto the spindle for articulating the lever, and in that the spindle of the branch bears against a bearing wall formed by the deflection means, and the other branch bears against the rear face of the extension.

14. The device as claimed in claim 10, characterized in that the spindle for deflecting the strap has a convex or conical configuration allowing the strap to be oriented obliquely in relation to the endless belt, the width of said strap being adapted to the profile of the spindle.

15. The device as claimed in claim 10, characterized in that the strap has its end strand free, with a narrowed end being coupled to the control handle of the means, the handle being made in the form of a grab strip of elastomeric material.

16. The device as claimed in claim 10, characterized in that the strap is provided over part of its length, at the point where it passes over and around the deflection means, with a graduated scale which defines relative positions of the rucksack back and of the harness in relation to a reference index established on the deflection means.

17. The device as claimed in claim 16, characterized in that the deflection means is able to accommodate a cap for protecting the locking mechanism, and in that the front face of the cap has a window facing the strap and its graduated scale, the reference index being carried on the cap.

* * * * *